United States Patent [19]

Wood

[11] 4,168,143

[45] Sep. 18, 1979

[54] PROCESS AND APPARATUS FOR THE PURIFICATION AND RE-USE OF WOOL-SCOURING LIQUORS

[75] Inventor: George F. Wood, Highton, Australia

[73] Assignee: Commonwealth Scientific and Industrial Research Corporation, Campbell, Australia

[21] Appl. No.: 862,100

[22] Filed: Dec. 19, 1977

[30] Foreign Application Priority Data

Dec. 23, 1976 [AU] Australia ..... PC 8607

[51] Int. Cl.[2] ..... D01C 1/00; D06F 29/00

[52] U.S. Cl. ..... 8/139; 8/158; 68/18 R

[58] Field of Search ..... 8/139

[56] References Cited

U.S. PATENT DOCUMENTS

| | | | |
|---|---|---|---|
| 2,552,944 | 5/1951 | Dubeau | 8/139 |
| 2,762,681 | 9/1956 | Crowley | 8/139 |
| 3,871,820 | 3/1975 | Stewart et al. | 8/139 |

OTHER PUBLICATIONS

Wood, G. F. and Anderson, C. A., Textile Institute and Industry, Mar. 1976, pp. 87–89.

*Primary Examiner*—A. Lionel Clingman
*Attorney, Agent, or Firm*—Harold L. Stowell

[57] ABSTRACT

A process for reducing the pollutant concentration of effluent liquor from wool-scouring operations. The suint concentration of scouring liquor is allowed to build up to a point where suspended dirt and grease particles are destabilized and hence more efficiently removed by centrifugation. The centrifuged liquor is then recycled for further wool-scouring. Apparatus is also provided.

7 Claims, 4 Drawing Figures

A Centrifuging starts, recovery rather low

B Normal operation, recovery about 40%

C Onset of destabilization, recovery rises rapidly

D Destabilization complete

E Equilibrium operation, recovery about 85%

PROCESS AND APPARATUS FOR THE PURIFICATION AND RE-USE OF WOOL-SCOURING LIQUORS

This invention is concerned with the scouring of wool and provides a technique and apparatus for carrying out the process whereby the scouring of raw wool can be effected efficiently and without the production of objectionable effluent.

The particular object of this invention is to purify wool-scouring liquors so that they may be re-used in the scouring machine and at the same time reduce effluent disposal problems. Moreover, this may be achieved by a preferred embodiment of the invention without adding additional chemicals to the liquor and without departing substantially from procedures normally used for scouring wool.

In ordinary wool scouring, impurities are removed from the wool by washing it in several bowls containing detergent solutions. In the best practice, wool passes from bowl to bowl in one direction, and liquor is pumped in the opposite direction. The raw wool enters the first bowl, and becomes cleaner as it moves towards the last. Clean water enters the last bowl and becomes dirtier as it moves towards the first. Detergent chemicals are added continuously to the first few bowls in an amount proportional to the weight of wool passing through the machine.

The dirty liquor in the first bowl is pumped continuously through a centrifuge and back to the bowl at a rate sufficient for the whole contents of the bowl to pass through the centrifuge in one to two hours. The centrifuge separates grease and dirt from the liquor, both products being accompanied by quantities of water. The grease product is usually washed and de-watered in other centrifuges, and the dirt in the form of a thin slurry is discharged, sometimes accompanied by additional centrifuged liquor. The quantity discharged in this way is commonly between 10 to 20 liters for each kilogram of greasy wool passing through the machine.

In this method of scouring, the centrifuge removes only a part of the dirt and grease, so the concentration of these contaminants in the first bowl gradually increases. Eventually the liquor becomes too dirty for acceptable scouring, and the bowl has to be discharged and cleaned. Thus, in addition to the centrifuge discharge described above, an additional quantity of highly polluted liquor is discharged whenever the bowls need cleaning.

The total waste liquor typically contains 7000 mg of Biological Oxygen Demand (BOD), 6000 mg of suspended solids and 4000 mg of grease per liter, and is very difficult to purify by known methods. One method of purification involves removing the suspended dirt and grease particles from the liquor and then subjecting it to a biological digestion to remove the dissolved impurities.

The changing of the nature of a suspension from the stable condition in which the particles cannot be removed by settling or centrifuging to the unstable condition in which they separate relatively easily is hereinafter referred to as destabilization. It can be achieved in three ways, at least in theory: firstly, by causing the particles to aggregate into larger particles, secondly by changing the density of the particles so that buoyancy forces are increased or decreased, so causing the particles to float or sink; thirdly, by changing the density of the liquid, again causing changes in buoyancy forces. The last mentioned method involves adding soluble substances to the liquor, and has not been used in practice because a large proportion of solute is required to achieve a significant density change and subsequent recovery of the solute is not economically feasible.

I have now devised a method for destabilizing a scouring liquor by increasing its density using a solute normally present in the liquor. This solute is suint, the water-soluble component of the fleece, consisting mainly of the potassium salts of organic acids. Typically, the concentration of suint which is effective in bringing about suspension destabilization is of the order of 5% by weight. FIG. 4 is a graph illustrating the dramatic change in centrifugation efficiency as suint concentration increases from process start-up. When the scouring liquor is destabilized in this way, all of the suspended dirt and grease can be removed by centrifuging in commercial centrifuges, and the clean liquor, still containing the dissolved suint, is suitable for re-use in the scouring machine.

Thus, in one form, the invention provides a wool-scouring process in which wool is treated with an aqueous detergent scouring liquor by immersion or jetting in at least one scouring bowl, preferably two or more, to produce a dirty wash liquor or liquors containing the suint, grease and dirt components of the fleece in aqueous suspension or solution, the process being characterised in that at least one portion of liquor is used for scouring wool until the concentration of the suint therein reaches a level where the suspension is destabilized, the destabilized liquor is passed through at least one centrifuge to remove dirt (in the form of a sludge) and grease (in the form of a cream) therefrom before being recirculated for use in scouring wool, and further characterised in that make-up water is provided to the bowl at a rate sufficient to make up for losses in the sludge, grease and wool, but insufficient to lower the suint concentration of the liquor to a level where restabilization of the suspension occurs.

As indicated, the concentration at which destabilization occurs is achieved by stopping (or limiting) water discharge from the machine (except for small quantities discharged with the wool, the dirt sludge and the grease); water input is correspondingly reduced, and as a result the concentration of all pollutants in the first bowl is increased. Liquor from the bowl can be recycled through centrifuges in the ordinary way, but the single machine ordinarily used may be replaced by one or more centrifuges capable of extracting separately from the liquor the dirt in the form of a sludge having a water content of less than about 70%, and the grease in the form of a cream. A suitable arrangement is a horizontal decanter centrifuge for removing the dirt followed by a normal grease centrifuge. Liquors from the second and third bowls may also be circulated through the centrifuges.

As soon as the destabilization point is reached, there is a sharp increase in the efficiency of the centrifuge(s), and the grease and dirt contents of the liquor fall to low values. The point is also marked by an easily recognized change in the colour of the scour liquor from milky grey to dark brown. Typically, an equilibrium liquor in a first bowl might contain 12% of suint, 3% of grease and 1% of dirt, the last two figures being similar to figures regarded as quite acceptable in the liquor of the first-bowl of a conventional system.

A consequence of the low water additions is that the concentrations of contaminants in all the bowls will be higher than usual, and the cleanliness of the wool emerging from the machine may be unacceptable. An optional feature of this process, therefore, is that the number of bowls in the scouring machine may be increased to six or seven instead of the usual four or five.

Accordingly, this invention also offers apparatus for scouring wool which, in general terms, comprises means for subjecting wool to the action of a wool-scouring liquor countercurrently in several bowls, there being in circuit with at least one bowl, one or more centrifuges capable of extracting dirt and grease from the liquor, the liquor in said circuit being isolatable from liquor in other sections of the apparatus and means for providing water to the circuit to make up for losses incurred during dirt grease and wool removal.

The design of the first few bowls in a machine operating according to the process of the invention should, ideally, conform to certain requirements. The first is that, to avoid accumulation of dirt in the machine, there should be no stagnant spots, and the whole of the bowl contents should be circulated through the centrifuges at regular intervals. The second is that, since the water input is very low, the number of passages of the liquor through the centrifuge(s) per unit time must be high if a high equilibrium concentration of suspended contaminants is to be avoided; the bowl volume should be small enough to permit the whole of the bowl contents to pass through the centrifuge(s) preferably at least three times per hour. The third is that, since highly contaminated liquors may be circulating in the bowl from time to time, an arrangement must be adopted that permits the wool to progress through the machine satisfactorily in the presence of these liquors.

In one embodiment of this invention these requirements are met by an apparatus in which a "bowl" or scouring stage comprises an inclined chute down which wool is caused to slide by the action of scouring liquor sprayed or jetted upon it. The chute is perforated in such a way that enough liquid flows down it to carry the wool along, but enough drains through the perforations to prevent flooding at the lower end. Typically, the perforations will offer an open area in the range 30–55%. The wool is delivered from the lower end of the chute to the nip of squeezing rollers, which in turn deliver it to the next processing stage, which may be the top of the chute belonging to a further scouring stage. The liquor expressed from the wool by the squeezing rollers and draining through the perforated chute passes through a screen to remove fibres, then to a small storage tank or sump from which it is pumped again to the jets. Liquor temperature is maintained at the required value by means of a thermostatically-controlled indirect heater situated in the pump delivery line.

In a machine containing several bowls of the type described above, liquor from the second and third bowls may also be circulated through the centrifuges according to a predetermined time schedule, approximately proportional to the concentration of contaminants in the liquor. The liquor level in each bowl is maintained by countercurrent flow of liquor from the preceding stage through a level-controlled valve.

A scouring machine could be made entirely of bowls of the type described, or it could be a combination of a number of bowls of this type with a number of conventional bowls, that is, where the wool is immersed in a bath of liquor and transported therethrough under the action of, say, rakes or paddles. In the first case, the machine would have three inputs—dirty wool, detergent chemicals and a small quantity of water—and three outputs—clean wool, a solid sludge and grease. There would be no liquid effluent to be discharged.

In the second case, the first few bowls would be operated according to the principles described, and the conventional bowls would be operated under normal counterflow conditions to discharge the ordinary quantity of water, which of course would contain only the small quantity of pollutants not removed in the first section.

Thus, according to another aspect of the present invention, a wool scouring machine is provided characterised in that the wool to be scoured is fed down a perforated inclined plate to the nip of a pair of squeeze rolls by the combined action of gravity and the jets of liquor applied before or after, or before and after, the point of addition of the raw wool to be scoured. It is possible to employ jets angled to the centre line of the chute to reduce the width of the mat of wool being fed to the rolls, and thereby to allow for the expansion of the mat by passage through the rolls. The inclined jets are also advantageous in that they provide more effective penetration of the loose wool by the scouring liquor. Alternatively the width of the wool mat may be reduced by using a perforated plate with converging sides.

According to another preferred feature of the present invention, the perforated inclined plate mentioned above is characterised by the fact that the scouring liquor is jetted onto the raw wool by a line of jets (or a single slotted jet) extending transversely of the inclined plate and the direction of wool movement. Also, the inclined plate is either not perforated immediately under the line of jets (i.e., where the jets of liquor impinge on the plate) or the perforations are effectively blocked in that region so that the scouring liquor striking the plate will not immediately pass therethrough but be directed to flow down the plate and carry the wool with it. As indicated above, a line of jets is preferably provided before the point at which the raw wool is introduced on to the inclined plate as well as at one or more points following that point.

In order to further assist the transport of the saturated wool through the rolls, it is preferable to form one or both of the rolls with an irregular surface as might be achieved by roughening or slotting the cylindrical surface of the rolls to a slight degree. Additionally, one or more of the rolls may be lapped with an absorbent material such as wool. Another optional feature of the present invention which may facilitate the feeding of the saturated wool through the squeeze rolls, is the provision of an adjustment mechanism whereby the angle of inclination of the inclined plate, and/or its proximity to the nip of the rolls, can be adjusted. Some wools may have a tendency to adhere to the lower of the squeeze rolls; to counteract this, a small conveyor belt having a rough surface may be positioned adjacent the lower roll on the output side to ensure that adhering wool is stripped off. Short-fibre wools, in particular, may jam at the entry to the nip of the squeeze rolls; their steady progress through the rolls can, however, be ensured by arranging for a blade to reciprocate towards and away from the nip, thereby exercising a pushing effect on any accumulated wool.

According to another aspect of the present invention, a process is provided which comprises the steps of feeding wool to be scoured to a first pair of squeeze rolls while jetting the wool with a hot, concentrated, detergent wash liquor, collecting the concentrated wash liquor expressed from the wool by the rolls, removing solids and grease therefrom by centrifugation or other means and returning the processed wash liquor to jet further wool. Preferably, the wool is fed through a series of squeeze rolls in a series of jetting and squeezing operations in which the wash liquor from each stage is fed counter-current to the wool travel until it is employed to jet the wool being fed to the first pair of squeeze rolls mentioned above.

According to another optional feature of the machine, the concentrated liquor of the first stage is drained into a small sump arranged below the inclined plate, liquor from the sump being circulated through the first stage of jets and the feed wool as well as through the centrifuges mentioned above. In order to maximise the effectiveness of the centrifuges, a heat exchanger is arranged in the liquor circuit between the first scouring stage and the first centrifuge which removes the solids, the heat exchanger being adapted to raise the temperature of the liquor to at least 90° C. Reductions in process energy requirements may be achieved if the liquor is cooled by passage through a heat exchanger before return to the scouring circuit.

As an alternative to jetting the liquor onto wool as described above, the wool may be treated by being transported through bowls of the liquor by the action of, say rakes or paddles.

A potential disadvantage of the process described is that, in a machine starting with fresh scouring liquors, a considerable running time could elapse before destabilization of the liquor occurred. During this time the concentration of pollutants in the bowls could build up to undesirable levels, with consequent unfavourable effects on the cleanliness of the scoured wool. I have found that this difficulty can be avoided by inducing a density change in the first-bowl liquor at the commencement of the run by adding an inorganic salt, in accordance with another preferable feature of this invention.

For example, an addition of about 10 percent of Glauber Salt will increase the density to about 1.03 g/ml, at which density the liquor will be destabilised. Since in the preferred apparatus the bowl volume is small, the quantity of salt required is also small. Furthermore, it is a once only addition, since the salt removed from the system in the sludge, grease and wool will be replaced by suint and the required density will be maintained.

In ordinary circumstances the liquors would not be discarded, but would continue to be used indefinitely. They can be left from day to day without deterioration, and experience has shown that the onset of bacterial decomposition of the liquors is inhibited by the high suint concentration, so they will stay fresh for longer periods than ordinary scouring liquors. However, if occasions arise when a bowl has to be emptied, the small volume of the preferred apparatus makes the storage or disposal of the liquor a simple matter.

The invention will now be described in further detail by reference to the following drawings of which:

Figure 1:
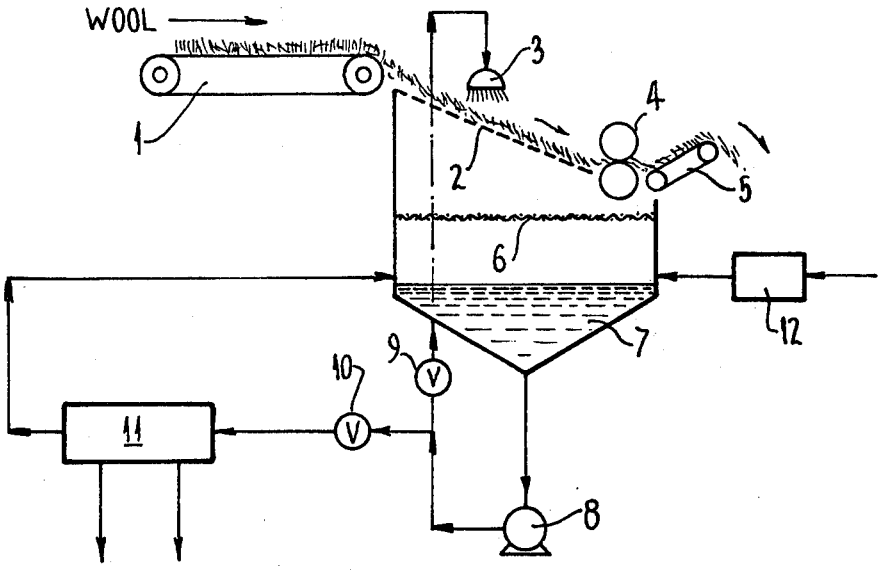
FIG. 1 is a schematic diagram of a typical scouring unit employing jets, or sprays and the associated liquor circuit.

In a unit as depicted in FIG. 1, untreated wool is introduced via conveyor 1 to the top of perforated chute 2, down which it proceeds under the combined action of gravity and jets of scouring liquor projected through 3. At the lower end of the chute the wool passes through the nip of squeeze rolls 4 aided by the conveyor belt 5. Scouring liquor percolating through chute 2 or expressed by the squeeze rolls passes through a fibre-retaining screen 6 to sump 7, from which it is pumped by pump 8 via valve 9 for recirculation through the wool or via valve 10 to centrifuge(s) 11 where dirt and grease are removed before the liquor is returned to 7. 12 is a device for admitting make up liquor to the system when the level falls to an unacceptable point because of losses incurred at 11 and 4.

Figure 2:
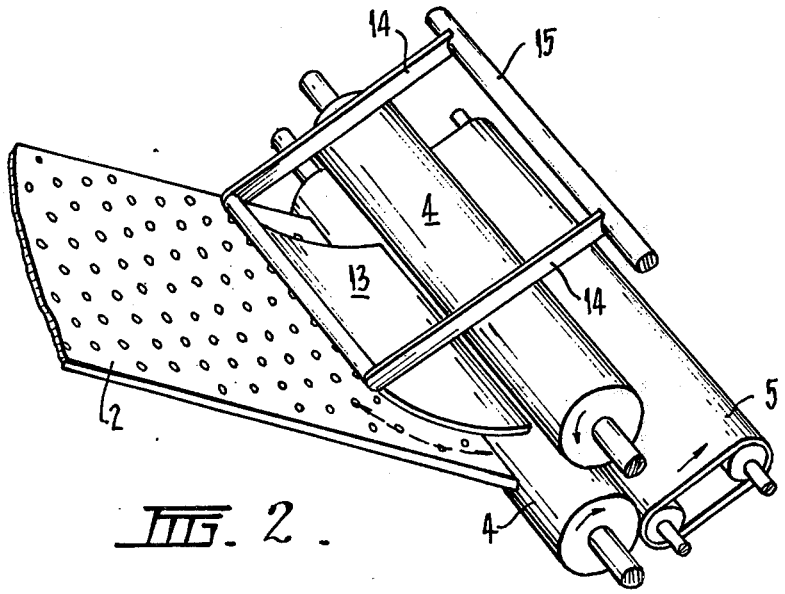
FIG. 2 illustrates preferred features for assisting the passage of wool through the squeeze rolls of a scouring unit wherein the scouring liquor is jetted or sprayed onto an inclined chute.

In FIG. 2 wool passing down the perforated inclined chute is assisted through squeeze rolls 4 by the reciprocating movement (shown by the dotted arrows) of blade 13. The blade is here depicted as being simply supported by levers 14 pivoted at 15; alternative arrangements may be employed to suit the geometry of the apparatus or to modify the direction of movement of the blade. On the further side of the squeeze rolls, the conveyor belt 5 is positioned close enough to the bottom roll to discourage any tendency for wool to adhere and continue being carried round on the roll, a clearance of about 3 mm has been found to be suitable. The direction of movement of squeeze rolls and conveyor belt is shown by the solid arrows.

Figure 3:
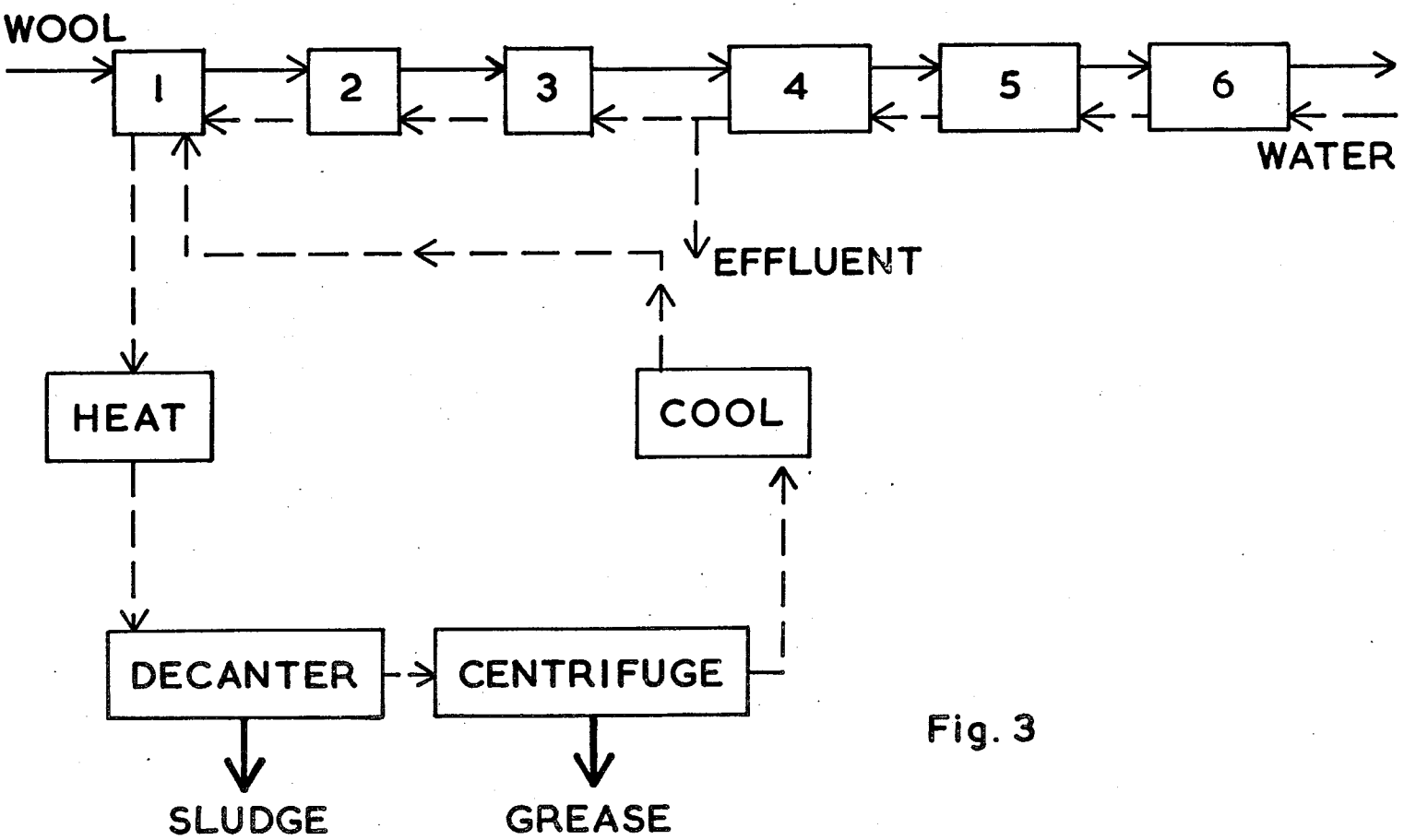
FIG. 3 illustrates the flow of materials through a typical scouring installation according to the invention.
Figure 4:
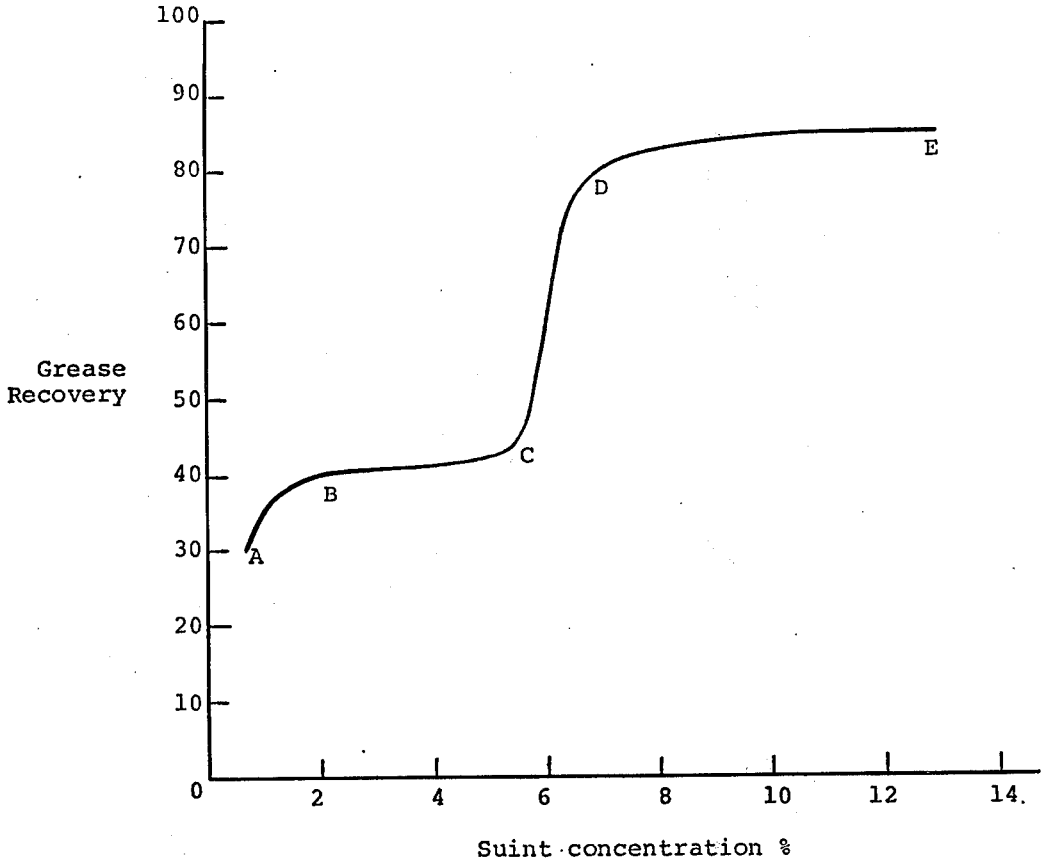
FIG. 4 is a graph illustrating the dramatic change in centrifugation efficiency as suint concentration increases from process start-up.

In FIG. 3 a system is depicted which has three scouring units (1–3) according to this invention, and three counter-current conventional scouring bowls (4–6). The liquid flow line is represented by broken arrows, the wool flow by narrow solid arrows, while the broad solid arrows show the efflux of dirt (sludge) and grease; detergent is introduced into scouring units (1–3), and into the conventional bowls as required.

Several advantages are obtained by using the effluent treatment process described above. One is that the yield of grease from the centrifuge is greatly increased. In conventional scouring, the amount of grease recovered is usually not more than 40% of the grease removed from the wool. In the process claimed, between 70% and 80% is recovered, the balance being lost in the sludge. Since the wool grease has a definite commercial value, the production of additional grease reduces the effective cost of the process.

Another advantage accrues from the fact that the concentrations of detergent chemicals in the liquors reach very much higher values than in ordinary scouring. This enhances the "density destabilization" effect, but also by surface activity causes some grease that would ordinarily have been lost in the sludge to separate from the dirt and so be recovered in the centrifuge. As a result, the grease content of the sludge averages about 10% of the dry solids, compared with double this figure for sludges from conventional scouring. For disposal purposes, sludges with low grease contents are preferable to those with high grease contents.

Compared with other effluent treatment processes, the method described is cheap to instal and to operate.

The cost of special scouring bowls of the preferred design is small compared with the cost of effluent treatment plant, and the cost of the additional sludge centrifuge required is no more than that of the equivalent de-watering device that would have to be used in conventional effluent treatment. The cost of destabilization is nil, since it is effected by using a material already in the system, whereas the usage of chemicals in conventional treatment plants is costly. The operating cost is virtually nil, since the labour and other requirements are identical to those in scouring.

A further advantage is that procedures for operating the process are almost identical to those already in use in ordinary scouring plants. It is therefore easy for existing personnel to operate the new process with a minimum of additional technical knowledge or training.

I claim:

1. A wool scouring process in which wool is treated with at least one portion of an aqueous detergent scouring liquor to produce a liquor containing the suint, grease and dirt components of the fleece is aqueous suspension or solution, the process being characterized in that the said portion of liquor is used for scouring wool until the concentration of suint therein reaches a level of at least about 5%, so that the dirt and grease components of the liquor change from being in a condition of stability to a condition of relative instability in which they may readily be substantially completely removed from the liquor by centrifuging, the destabilized liquor is passed through at least one centrifuge to remove dirt and grease therefrom and then recirculated for use in scouring wool, said process being further characterized in that water is provided to said portion of liquor at a rate sufficient to make up for losses incurred in dirt, grease and wool removal, but insufficient to lower the suint concentration to a level where restabilization of the suspension occurs.

2. A process according to claim 1 wherein the suint concentration in the said portion of scouring liquor is maintained at a level of at least 5% by weight.

3. A process according to claim 1 wherein the wool is treated with the said liquor by jetting or by immersion in a bowl thereof.

4. A process according to claim 2 wherein, before centrifugation, the destabilised liquor is heated to a temperature of at least 90° C.

5. A process according to claim 1 wherein, after treatment as described, the wool is further scoured and/or rinsed under counterflow conditions.

6. A process according to claim 1, wherein the wool is treated in several stages by scouring liquor flowing from stage to stage countercurrently to the flow of the wool, the quantity of liquor flowing into each stage being sufficient to make up for losses in that stage in the dirt, grease and wool.

7. A process according to claim 6, wherein scouring liquor from more than one stage is circulated through at least one centrifuge to remove dirt and grease therefrom, the circulation being successively from the different stages and determined according to a time schedule proportional to the contaminant levels in each stage.

* * * * *